US011395546B2

(12) United States Patent
Lee et al.

(10) Patent No.: US 11,395,546 B2
(45) Date of Patent: Jul. 26, 2022

(54) SLIDE DEVICE

(71) Applicant: SEGOS CO., LTD., Incheon (KR)

(72) Inventors: Doo Myun Lee, Incheon (KR); Ro Hee Lee, Incheon (KR)

(73) Assignee: SEGOS CO., LTD., Incheon (KR)

( * ) Notice: Subject to any disclaimer, the term of this patent is extended or adjusted under 35 U.S.C. 154(b) by 0 days.

(21) Appl. No.: 17/251,634

(22) PCT Filed: Jul. 3, 2020

(86) PCT No.: PCT/KR2020/008723
§ 371 (c)(1),
(2) Date: Dec. 11, 2020

(87) PCT Pub. No.: WO2021/006555
PCT Pub. Date: Jan. 14, 2021

(65) Prior Publication Data

US 2021/0169221 A1 Jun. 10, 2021

(30) Foreign Application Priority Data

Jul. 5, 2019 (KR) ..... 10-2019-0081384

(51) Int. Cl.
*A47B 88/467* (2017.01)
*A47B 88/931* (2017.01)
*A47B 88/483* (2017.01)

(52) U.S. Cl.
CPC ..... *A47B 88/467* (2017.01); *A47B 88/483* (2017.01); *A47B 88/931* (2017.01); *A47B 2210/0094* (2013.01)

(58) Field of Classification Search
CPC ... A47B 88/467; A47B 88/931; A47B 88/483; A47B 2210/0094; A47B 88/473; A47B 88/40
See application file for complete search history.

(56) References Cited

U.S. PATENT DOCUMENTS 7,244,005 B1 * 7/2007 Lu ..... A47B 88/467 312/319.1
7,967,402 B2 * 6/2011 Hoshide ..... A47B 88/467 312/333

(Continued)

FOREIGN PATENT DOCUMENTS

CN 108323969 A * 7/2018
KR 10-2007-0096813 A 10/2007

(Continued)

*Primary Examiner* — Hanh V Tran
(74) *Attorney, Agent, or Firm* — Novick, Kim & Lee, PLLC; Jae Youn Kim

(57) ABSTRACT

One embodiment of the present invention provides a slide device including a fixed rail fixedly installed on a main body, a moving rail provided to be movable with respect to the fixed rail, a body provided in an end region of one side of the fixed rail and including a guide passage, a slider which is coupled to the body and is selectively and slidably movable in a longitudinal direction of the body when the moving rail slidably moves, a transfer pin which is rotatably coupled to the slider and is movable along the guide passage, an elastic member disposed between and connected to the body and the slider and configured to be elastically compressed or expanded when the slider moves, and a damper which is provided on the body and of which an end portion of a rod is connected to the slider.

7 Claims, 11 Drawing Sheets

(56) References Cited

U.S. PATENT DOCUMENTS 8,277,002 B2 * 10/2012 Perez ..... A47B 88/467 312/333
8,393,693 B2 * 3/2013 Juan ..... A47B 88/467 312/333
8,651,597 B2 * 2/2014 Kimura ..... E05F 5/003 312/333
8,714,671 B2 * 5/2014 Huang ..... E05F 5/003 312/333
8,939,525 B1 * 1/2015 Chen ..... A47B 88/467 312/333
9,341,406 B2 * 5/2016 Jung ..... F25D 11/00
2006/0113169 A1 * 6/2006 Leon ..... A47B 88/467 200/5 R
2008/0100190 A1 * 5/2008 Yang ..... A47B 88/467 312/333
2009/0021129 A1 * 1/2009 Hu ..... A47B 88/467 312/333
2009/0091224 A1 4/2009 Wu
2009/0115300 A1 * 5/2009 Chen ..... H05K 7/1421 312/334.1
2009/0189499 A1 * 7/2009 Yang ..... A47B 88/467 312/334.44
2010/0026152 A1 * 2/2010 Huang ..... A47B 88/463 312/319.1
2011/0043087 A1 * 2/2011 Shih ..... A47B 88/467 312/334.1
2011/0175508 A1 * 7/2011 Rechberg ..... A47B 88/467 312/334.8
2012/0144622 A1 * 6/2012 Juan ..... A47B 88/467 16/51
2013/0028544 A1 * 1/2013 Lowe ..... A47B 88/467 384/21
2014/0079347 A1 * 3/2014 Huang ..... A47B 88/467 384/21
2015/0131929 A1 * 5/2015 Park ..... A47B 88/467 384/21
2017/0086583 A1 * 3/2017 Chen ..... A47B 88/463
2018/0132615 A1 * 5/2018 Kim ..... A47B 88/467
2018/0306236 A1 * 10/2018 Liu ..... A47B 88/49
2019/0069672 A1 * 3/2019 Pan ..... E05F 5/027

FOREIGN PATENT DOCUMENTS

KR 10-2016-0137307 A 11/2016
KR 10-1742643 B1 6/2017
WO WO-2016186288 A1 * 11/2016 ..... A47B 88/473

* cited by examiner

SLIDE DEVICE

TECHNICAL FIELD

The present invention relates to a slide device, and more specifically, to a slide device capable of inserting a storage body in a self-closing manner and a soft-closing manner and allowing a transfer pin and a damper member to be separated so that a component and a structure are simplified.

BACKGROUND ART

Generally, sliding type storage bodies are provided with main bodies of furniture, refrigerators, various utility boxes, and the like to be openable and closable in a sliding manner so as to input and store necessary things therein.

The sliding type storage body is opened and closed by slide devices, which are installed between wall surfaces inside an installation space provided in a main body and both side surfaces of the storage body, and provided to be slidably movable due to a rolling contact therebetween.

The slide device includes a fixed rail fixedly installed on the main body and a moving rail which is provided to be slidably movable with respect to the fixed rail to guide opening and closing actions of the storage body, and a damper member configured to decrease an insertion speed and a withdrawal speed of the moving rail to be less than a predetermined speed is additionally provided on the fixed rail.

However, the conventional slide device has a structure in which an end portion of a rod of a damper is connected to a sub-transfer pin. In this case, the sub-transfer pin to be coupled to the end portion of the rod of the damper and a transfer pin which is rotatably coupled to the sub-transfer pin and is movable along a guide passage should be provided in a slider.

That is, in the conventional slide device, in addition to the generation of disadvantages in that the number of components is increased due to the above-described reasons, and a structure is complex over a predetermined level, since all of the end portion of the rod of the damper, the transfer pin, and the slider should be coupled to the sub-transfer pin, there is a disadvantage in that the durability of the slide device is degraded when the slide device moves back and forth for a long time.

RELATED ART (Patent Document 1) Korean Patent Publication No. 10-1742643 (May 26, 2017)

DISCLOSURE

Technical Problem

The present invention is directed to providing a to a slide device capable of inserting a storage body in a self-closing manner and a soft-closing manner and allowing a transfer pin and a damper member to be separated so that a component and a structure are simplified.

Technical Solution

One aspect of the present invention provides a slide device including a fixed rail fixedly installed on a main body, a moving rail provided to be movable with respect to the fixed rail, a body provided in an end region of one side of the fixed rail and including a guide passage, a slider which is coupled to the body and is selectively and slidably movable in a longitudinal direction of the body when the moving rail slidably moves, a transfer pin which is rotatably coupled to the slider and is movable along the guide passage, an elastic member disposed between and connected to the body and the slider and configured to be elastically compressed or expanded when the slider moves, and a damper which is provided on the body and of which an end portion of a rod is connected to the slider.

The guide passage may include a first guide passage formed to extend in the longitudinal direction of the body, and a second guide passage connected to the first guide passage in an end region of the first guide passage and provided to be bent with respect to the first guide passage.

The transfer pin may include a pin body, a rotating shaft part formed on one end portion of the pin body and coupled to the slider, an upper protrusion which is formed on the other end portion of the pin body, protrudes from one surface of the pin body, and is insertable into a through part formed in the slider, and a lower protrusion which is formed on the other end portion of the pin body, protrudes from the other surface of the pin body to correspond to the upper protrusion, and is movable along the guide passage when the slider moves, wherein the transfer pin may be provided to be rotatable about the rotating shaft part with respect to the slider.

In a state in which the lower protrusion is positioned in the second guide passage, an angle ($\theta 1$) formed by an inner fixed surface (S) of the second guide passage to which the lower protrusion is fixed and a line (L) connecting the lower protrusion and the rotating shaft part may be in the range of 70° to 120°.

In the state in which the lower protrusion is positioned in the second guide passage, an angle ($\theta 2$) at which the transfer pin is rotatable about the rotating shaft part may be in the range of 10° to 45°.

A first coupling part and a second coupling part which are coupled to the slide may be provided on the end portion of the rod of the damper, a neck part concavely recessed to relatively decrease a cross sectional area thereof may be provided between the first coupling part and the second coupling part, and a first insertion part, which is formed in a shape corresponding to the first coupling part to be insertion-coupled to the first coupling part, and a second insertion part coupled to the second coupling part may be provided at one side of the slider.

The first insertion part may include a neck part insertion groove into which the neck part is inserted.

The second insertion part may include at least two column parts spaced apart from each other, and an insertion groove may be formed between the column parts so that the second coupling part is coupled thereto.

The elastic member may be installed at any one of an upper side and a lower side of the body.

Advantageous Effects

According to one aspect of the present invention, since an end portion of a rod of a damper is directly connected to a slider, a structure of a transfer pin can be simplified and the durability thereof can be improved.

In addition, since the transfer pin is able to rotate about the slider when a moving rail moves back and forth, a coupling structure between peripheral components and the transfer pin is further simplified, and coupling and separation are easy.

In addition, since an angle formed by an inner fixed surface of a second guide passage to which a lower protrusion is fixed and a line connecting the lower protrusion and a rotating shaft part is in a predetermined range, restrainability with respect to the transfer pin can be improved, and a loosening phenomenon of the transfer pin due to vibration and the like can be prevented.

It should be understood that the effects of the present invention are not limited to the above-described effects and include all effects derivable from the detailed description of the present invention or the configuration defined in the claims of the present invention.

MODES OF THE INVENTION

Figure 1:
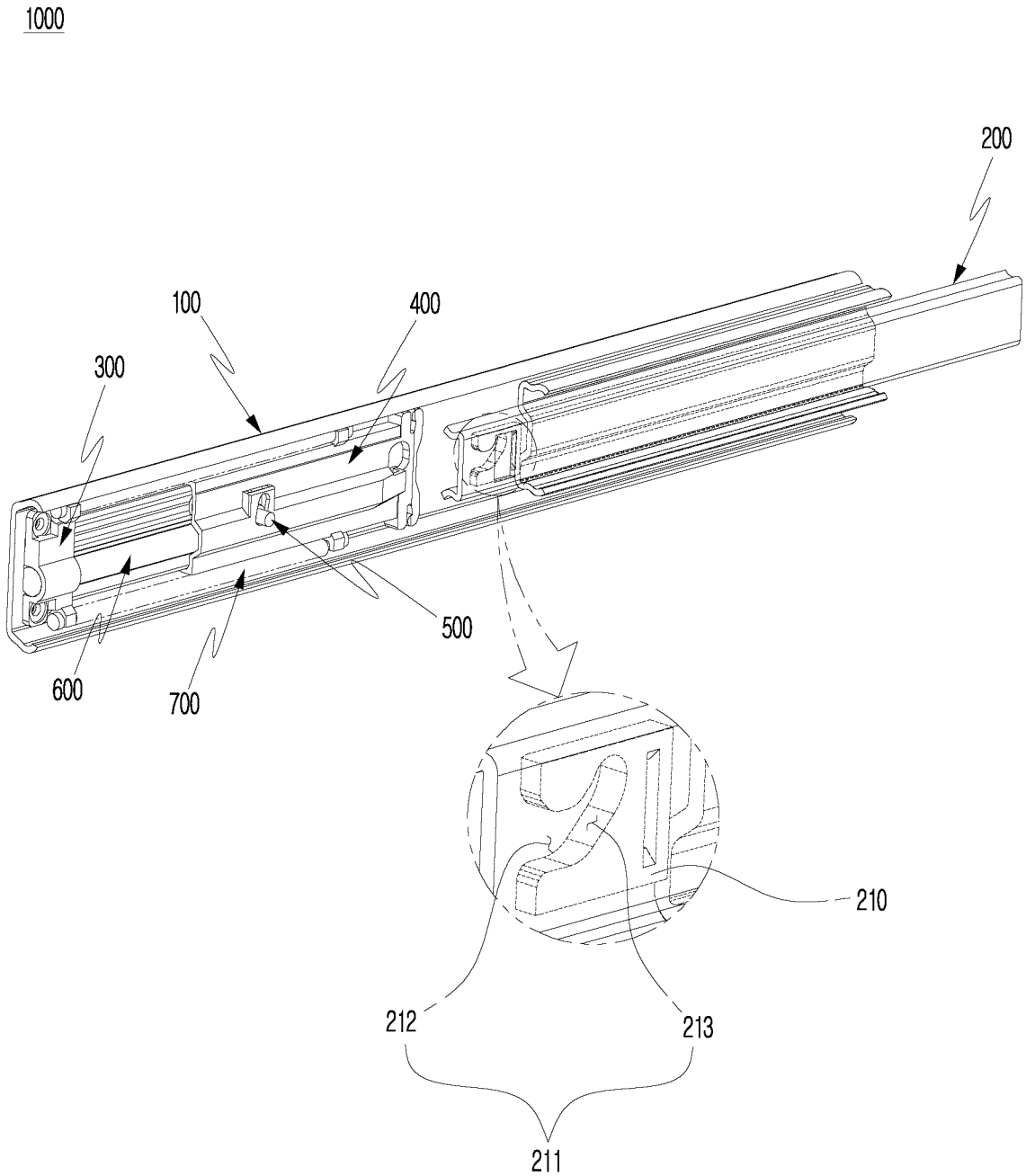
FIG. 1 shows a perspective view and a partially enlarged view illustrating a slide device according to one embodiment of the present invention.

Hereinafter, the present invention will be described in detail with reference to the accompanying drawings. However, embodiments of the present invention may be implemented in several different forms and are not limited to the embodiments described herein. In addition, parts irrelevant to description are omitted in the drawings in order to clearly explain the embodiments of the present invention. Similar parts are denoted by similar reference numerals throughout this specification.

Throughout this specification, when a part is referred to as being "connected" to another part, it includes "directly connected" and "indirectly connected" via an intervening part. Also, when a certain part "includes" a certain component, this does not exclude other components unless explicitly described otherwise, and other components may in fact be included.

Hereafter, embodiments of the present invention will be described with reference to the accompanying drawings.

A slide device 1000 according to the present invention is provided to smoothly and slidably move a drawer of a drawer type refrigerator or various furniture in a front-rear direction. Specifically, the present invention has a structure in which a user may push a storage body in a withdrawn state to perform self-closing of the storage body in the main body, and additionally, the storage body may perform soft-closing due to a buffer force of a damper 600.

In this case, "self-closing" refers that the storage body in the withdrawn state is automatically inserted by simply pushing the storage body when a user wants to insert the storage body, and "soft-closing" refers to a state in which a speed B is relatively less than a speed A, wherein the storage body is initially inserted into the main body at the speed A, after inserted thereinto to a predetermined extent, and finally inserted thereinto at the speed B.

Figure 2:
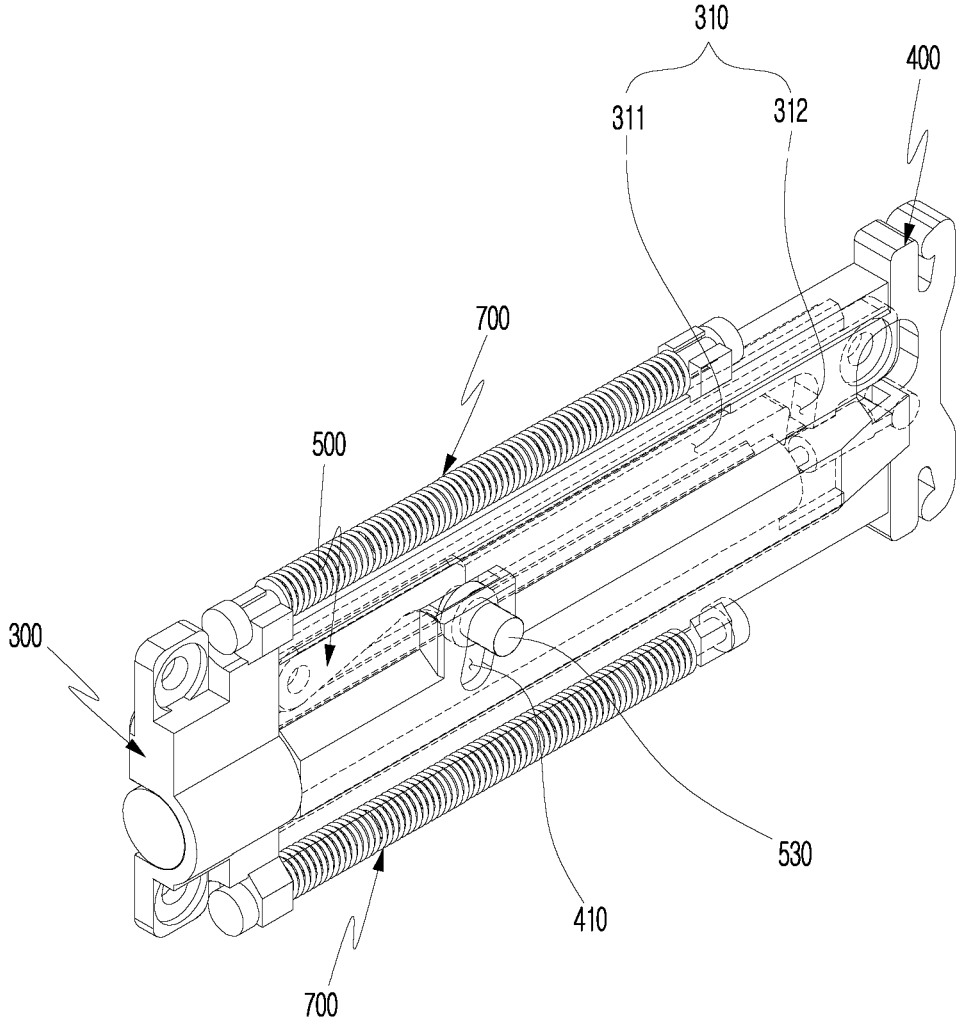
FIG. 2 is a perspective view illustrating some parts of the slide device according to one embodiment of the present invention.
Figure 3:
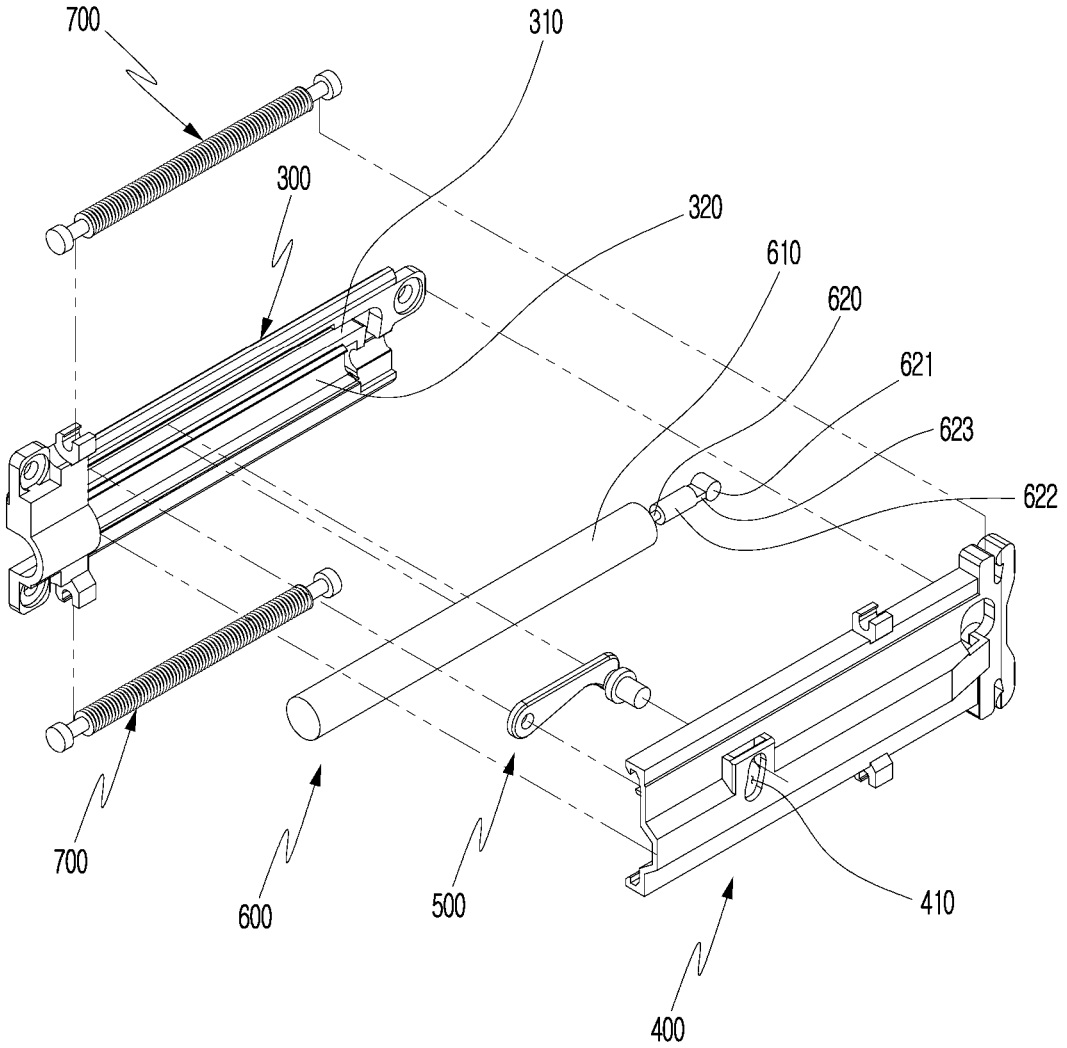
FIG. 3 is an exploded view illustrating some parts of the slide device according to one embodiment of the present invention.

FIG. 1 shows a perspective view and a partially enlarged view illustrating a slide device according to one embodiment of the present invention, FIG. 2 is a perspective view illustrating some parts of the slide device according to one embodiment of the present invention, and FIG. 3 is an exploded view illustrating some parts of the slide device according to one embodiment of the present invention.

Referring to FIGS. 1 to 3, the slide device 1000 includes a fixed rail 100 fixedly installed on the main body, a moving rail 200 provided to be slidably movable with respect to the fixed rail 100 and configured to guide an opening or closing action of the storage body, a body 300 which is provided in an end region of one side of the fixed rail 100 and in which a guide passage 310 is provided, a slider 400 which is coupled to the body 300 and is selectively and slidably movable in a longitudinal direction of the body 300 when the moving rail 200 slidably moves, a transfer pin 500 which is rotatably coupled to the slider 400 and is movable along the guide passage 310, an elastic member 700 disposed between and connected to the body 300 and the slider 400 and elastically compressed or expanded when the slider 400 moves, and the damper 600 which is provided on the body 300 and of which an end portion of a rod 620 is connected to the slider 400.

The fixed rail 100 is fixable to an inner wall of the main body such as an inner wall of a refrigerator or furniture through a screw and the like. The moving rail 200 is connected to the storage body so that the storage body is inserted into or withdrawn from the main body, and the moving rail 200 is provided to be slidably movable with respect to the fixed rail 100. The moving rail 200 is fixable to the storage body using a separate bracket (not shown).

Figure 4:
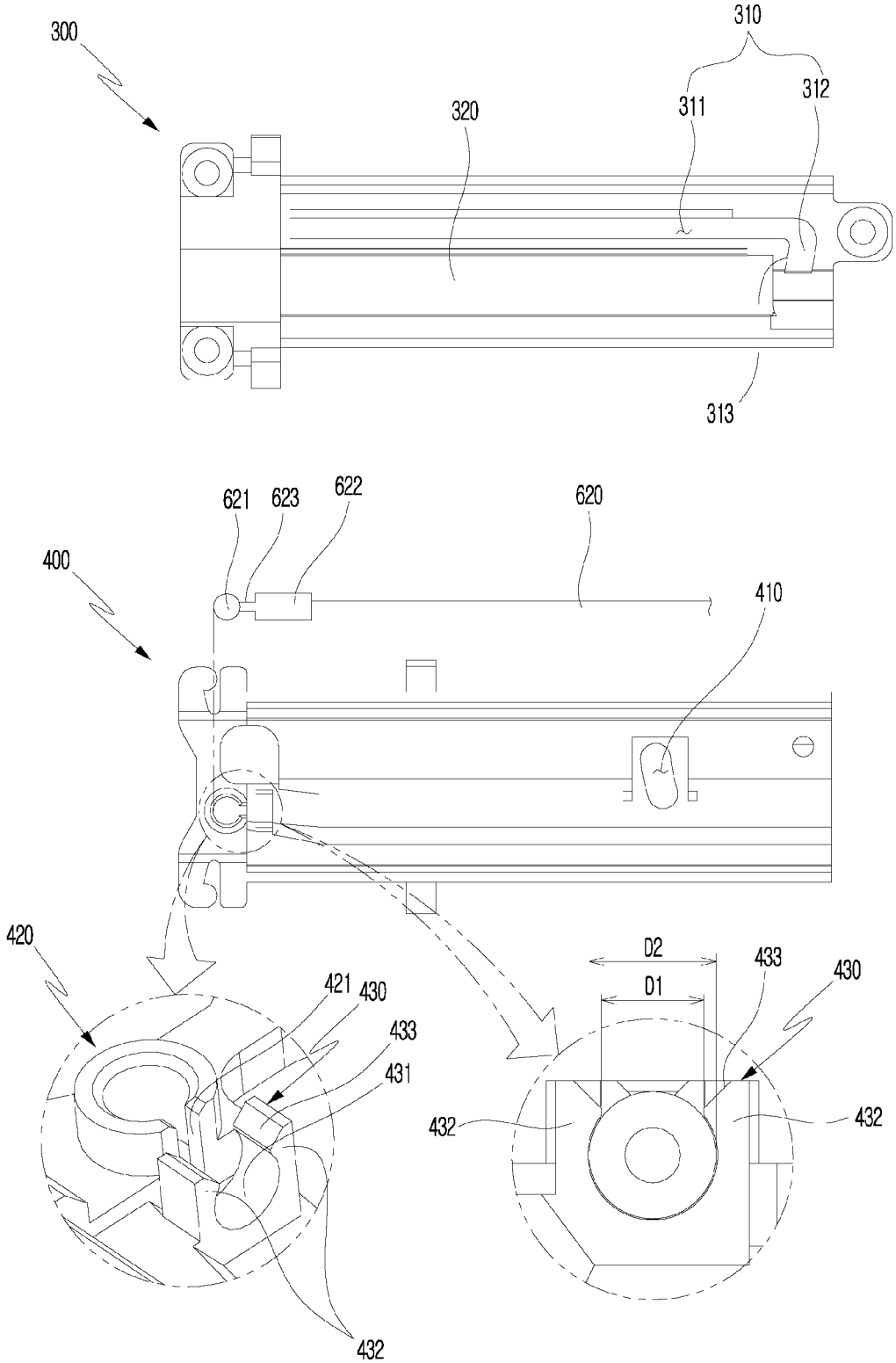
FIG. 4 shows a front view of a body, a rear view of a slider, and an enlarged view illustrating some parts of the slider according to one embodiment of the present invention.
Figure 5:
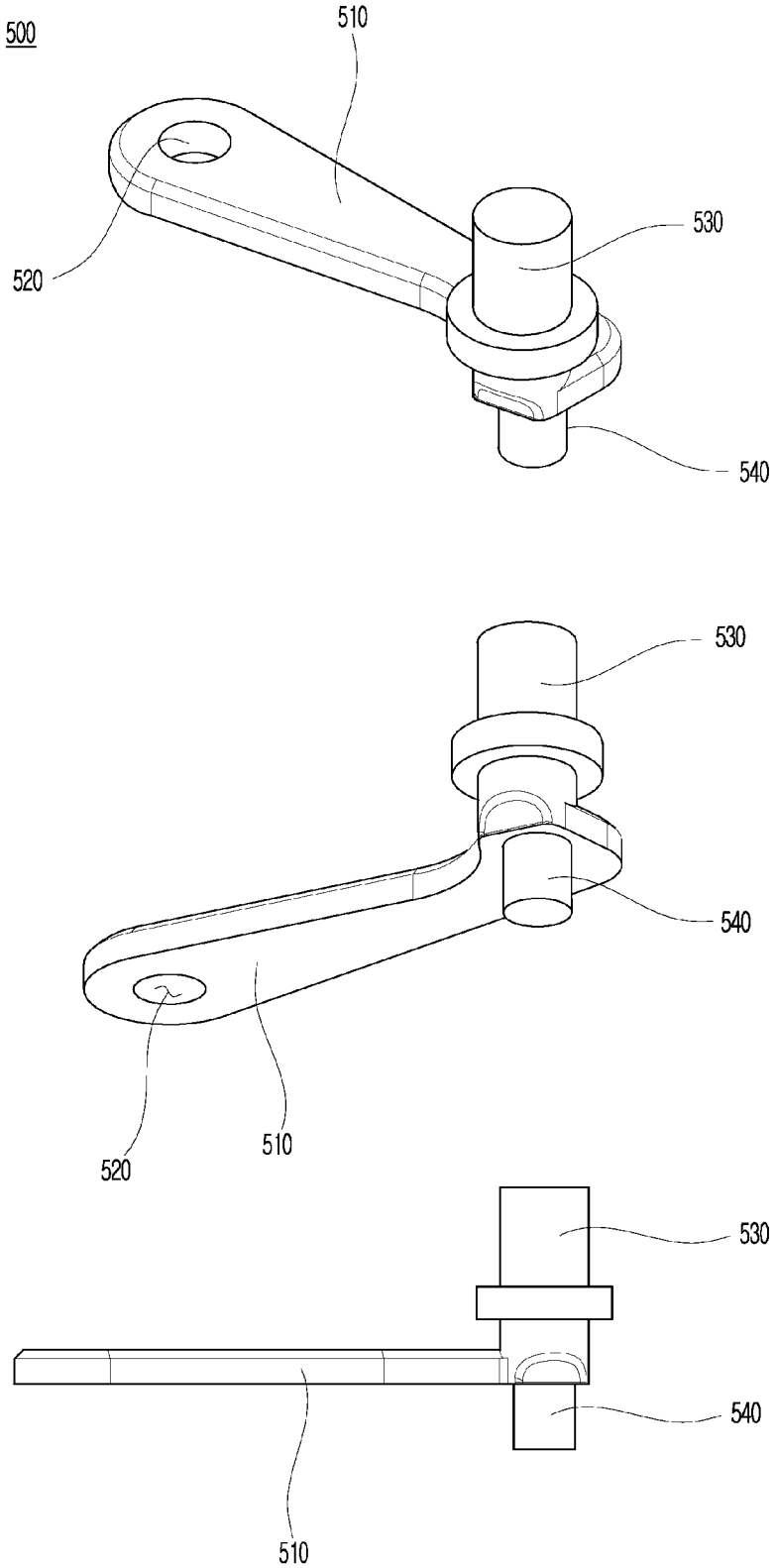
FIG. 5 shows a perspective view and a side view illustrating a transfer pin according to one embodiment of the present invention.
Figure 6:
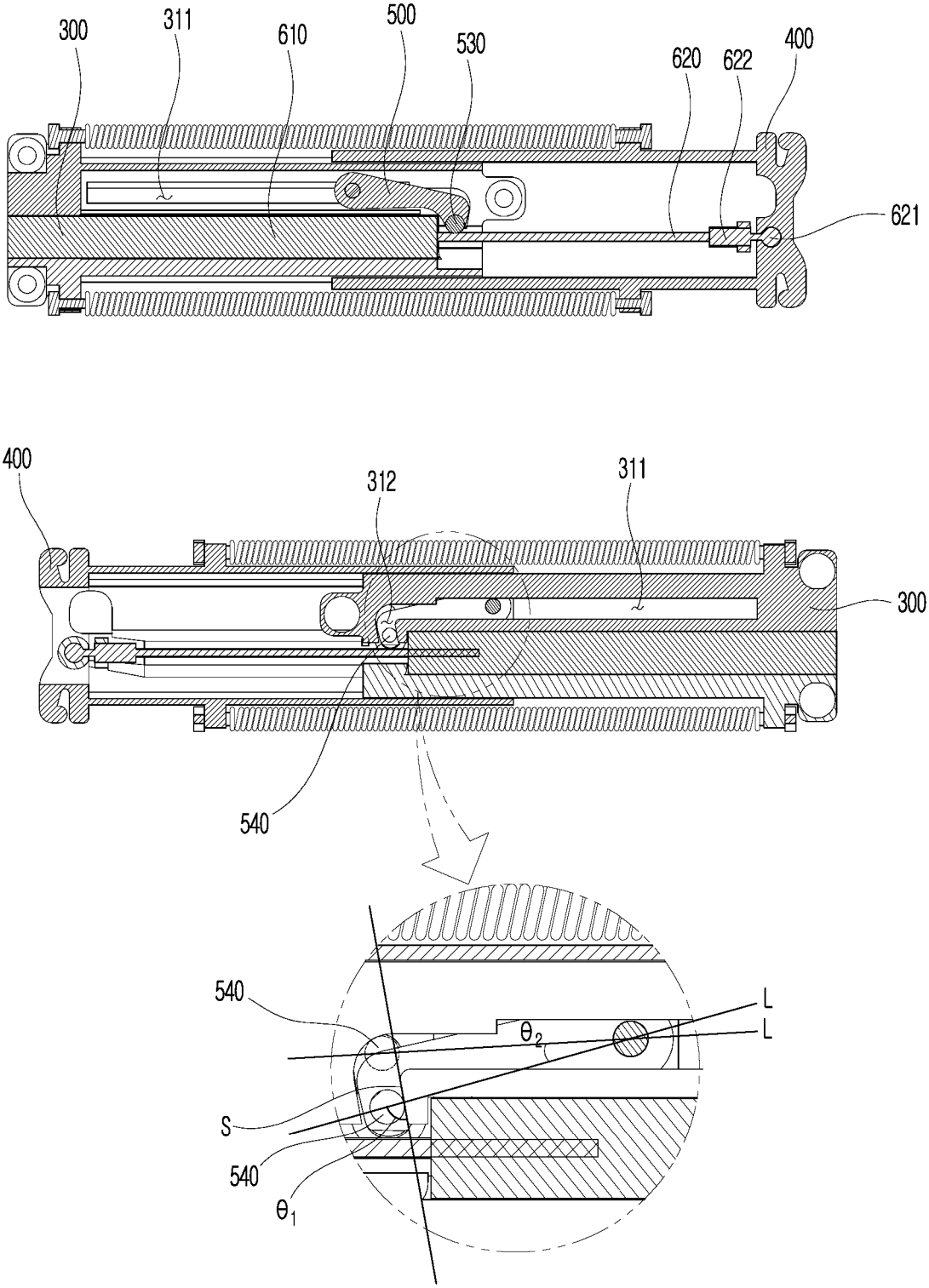
FIG. 6 shows front, rear, and partially enlarged views illustrating the slide device according to one embodiment of the present invention.

FIG. 4 shows a front view of the body, a rear view of the slider, and an enlarged view illustrating some parts of the slider according to one embodiment of the present invention, FIG. 5 shows a perspective view and a side view illustrating the transfer pin according to one embodiment of the present invention, and FIG. 6 shows front, rear, and partially enlarged views illustrating the slide device according to one embodiment of the present invention.

Referring to FIGS. 4 to 6, the body 300 is provided to be fixed to an end region of one side, specifically, a rear end region, of the fixed rail 100 and includes the guide passage 310 and a damper accommodation part 320.

The guide passage 310 includes a first guide passage 311 formed to extend in the longitudinal direction of the body 300 and a second guide passage 312 connected to the first guide passage 311 in an end region of the first guide passage 311 and provided to be bent with respect to the first guide passage 311.

In a state in which the moving rail 200 is withdrawn, a lower protrusion 540 of the transfer pin 500, which will be described below, is in a state of being positioned on an inner fixed surface S of the second guide passage 312. Then, when the moving rail 200 performs an insertion action, a position of the lower protrusion 540 is changed to a side of the first guide passage 311 from a position on the inner fixed surface S of the second guide passage 312 due to coupling of a transfer pin fixing part 210 provided on the moving rail 200 and an upper protrusion 530 of the transfer pin 500 provided on the slider 400 when the moving rail 200 moves.

A round having a predetermined curvature or more may be formed at a corner portion in which the first guide passage 311 and the second guide passage 312 are connected to smoothly perform movement of the lower protrusion 540, that is, to move the lower protrusion 540 to the first guide passage 311 from the position on an inner side of the second guide passage 312. In addition, the first guide passage 311 and the second guide passage 312 may be provided to form an acute angle therebetween so as to improve restrainability with respect to the transfer pin 500.

The damper accommodation part 320 may be formed to extend in the longitudinal direction of the body 300 and be parallel to the guide passage. In addition, the damper accommodation part 320 may have a space accommodating a housing 610 of the damper 600, which will be described below, and be formed in a shape corresponding to the housing 610. In addition, a groove part through which the rod 620 of the damper 600 may pass may be formed in one end portion of the damper accommodation part 320. That is, the housing 610 is formed to be fixedly accommodated in the damper accommodation part 320, the one end portion of the rod 620 is positioned in the housing 610, and the other end portion is fixed to the slider 400, which will be described below, to be movable with the slider 400 in a longitudinal direction.

Figure 7:
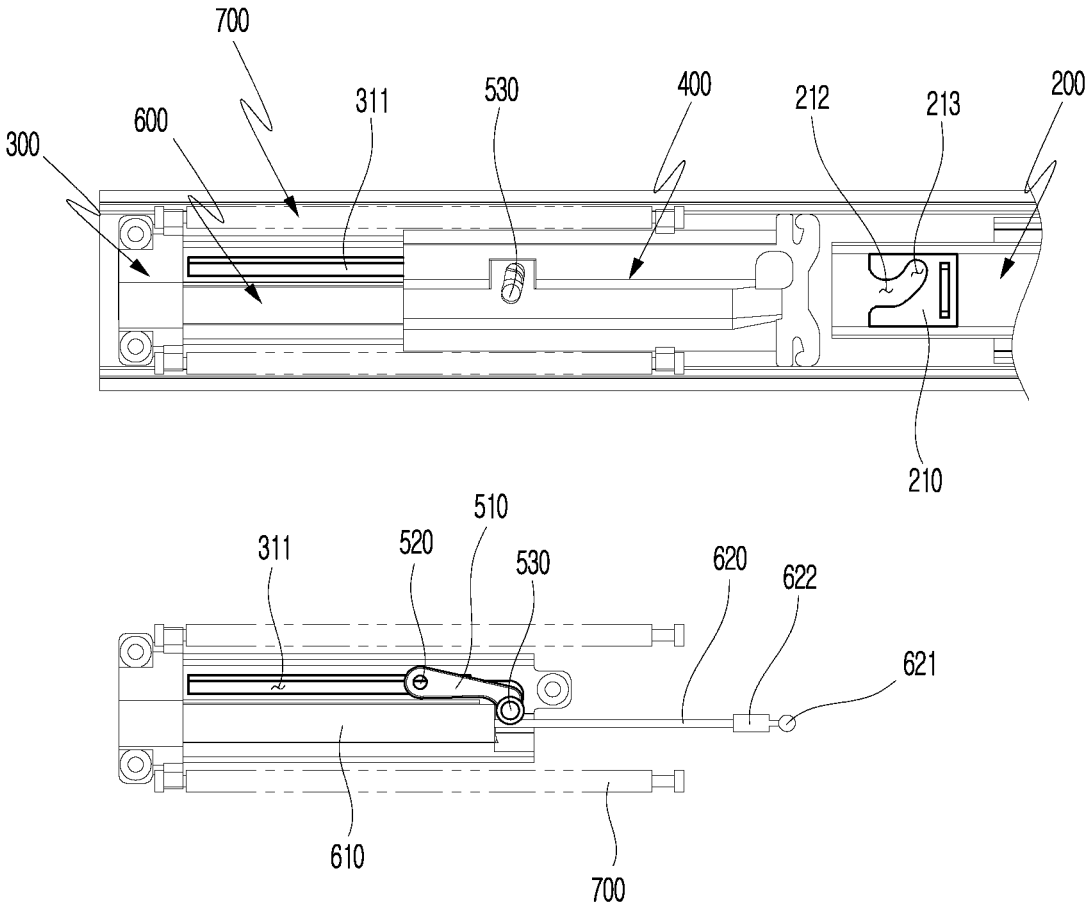
FIGS. 7 to 9 are front views illustrating an operational process when the slide device performs an insertion action according to one embodiment of the present invention.
Figure 8:
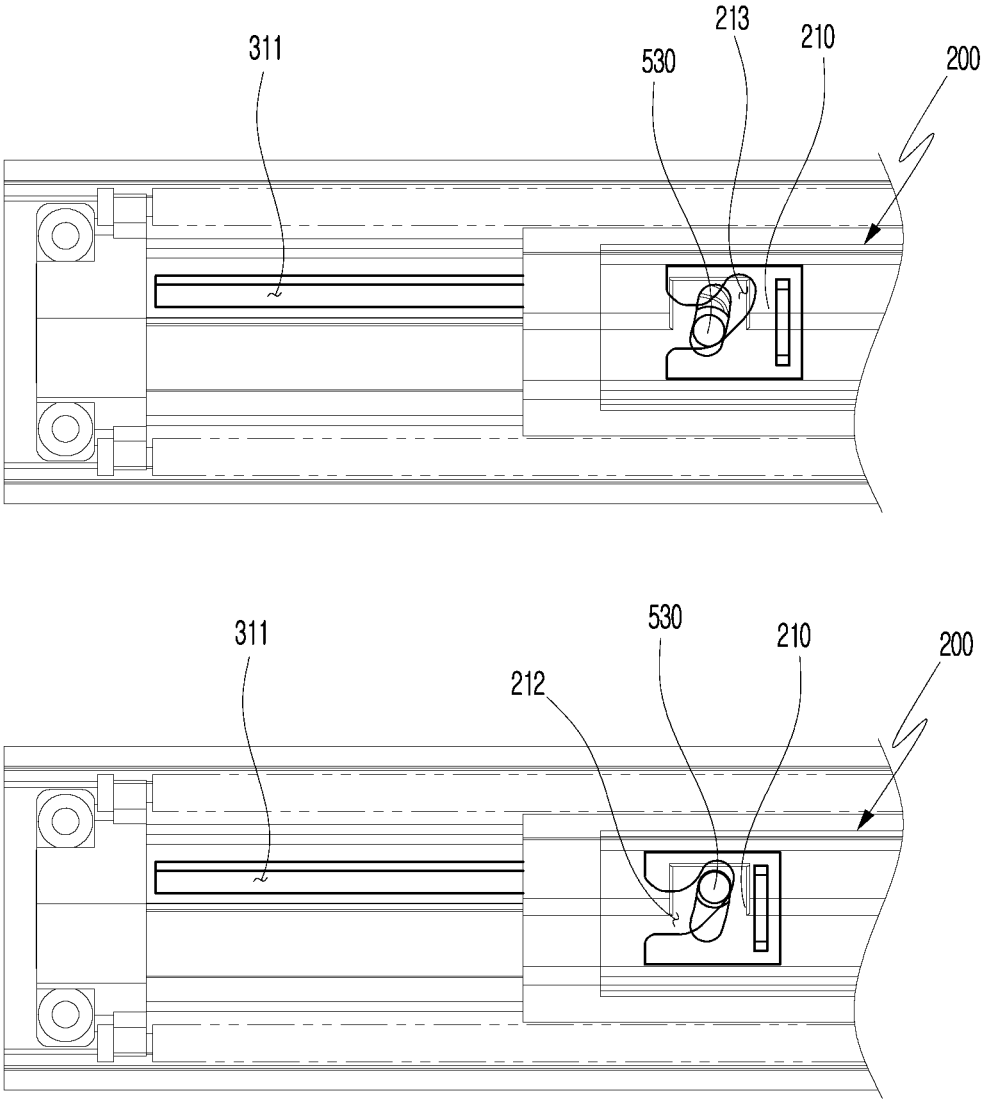
Figure 9:
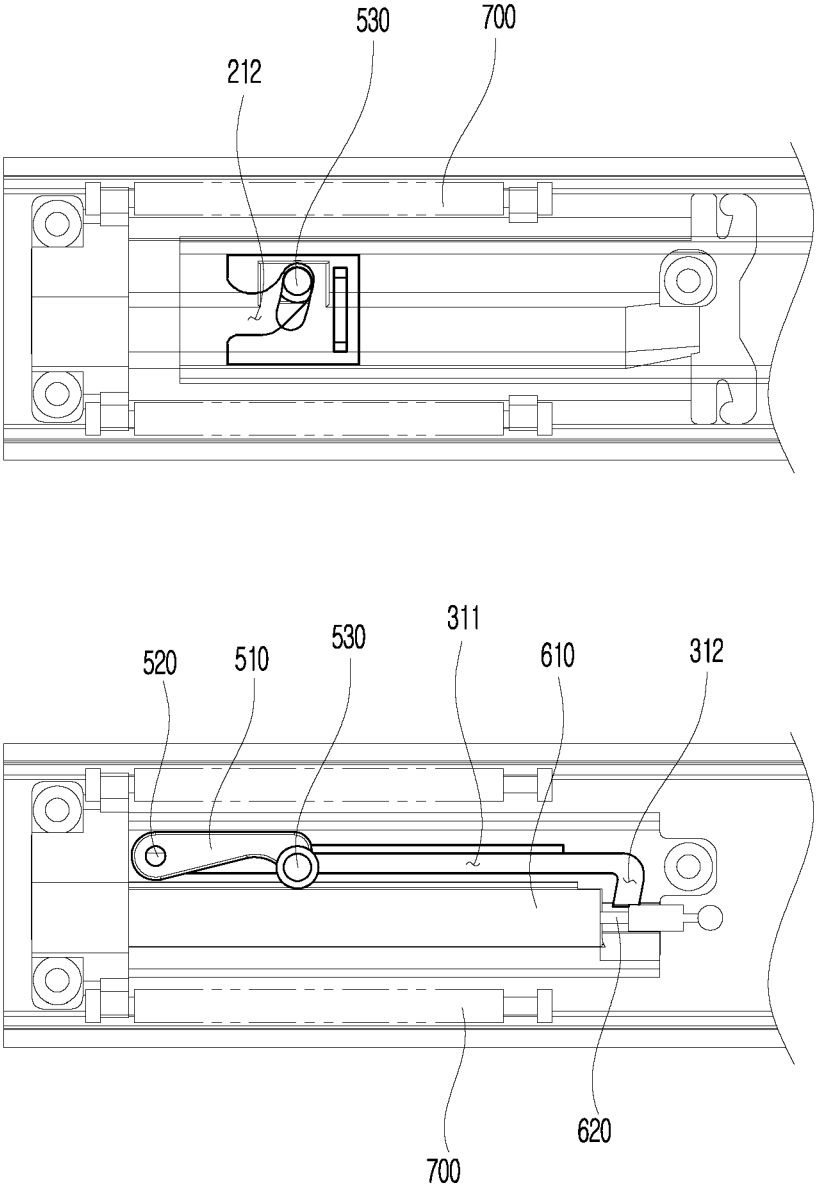

FIGS. 7 to 9 are front views illustrating an operational process when the slide device performs the insertion action according to one embodiment of the present invention.

Referring to FIGS. 7 to 9, in the present invention, when the moving rail 200 performs the insertion action, the lower protrusion 540 of the transfer pin 500 coupled to the slider 400 moves along the first guide passage 311. In this case, a state in which the upper protrusion 530 is coupled to the transfer pin fixing part 210 is maintained, and a self-closing action is performed by an elastic restoring force of the elastic member 700 which will be described below. In addition, when the self-closing action is performed as described above, a soft-closing action may also be performed due to a buffer force of the damper 600.

In addition, when the moving rail 200 performs the insertion action, the upper protrusion 530 of the transfer pin 500, which will be described below, enters an eccentric moving groove 211 of the transfer pin fixing part 210, specifically, enters a first eccentric moving groove 212. In this case, the lower protrusion 540 of the transfer pin 500 is positioned inside the second guide passage 312.

Then, when the moving rail 200 further moves thereinto, that is, due to the self-closing action performed by the elastic member 700, an arrangement position of the upper protrusion 530 is eccentrically changed to an inner side of the second eccentric moving groove 213. In this case, the lower protrusion 540 is positioned inside the first guide passage 311 due to eccentric movement of the upper protrusion 530. Accordingly, since hooking of the lower protrusion 540 is released, the transfer pin 500 rotatably coupled to the slider 400 enters a state in which the transfer pin 500 is movable along the first guide passage 311 with the slider 400.

Then, when the moving rail 200 further moves thereinto, the lower protrusion 540 further moves rearward along the first guide passage 311. In this case, the slider 400 and the transfer pin 500 are moved rearward by an elastic restoring force of the elastic member 700. In this case, while self-closing is performed on the moving rail 200 due to the elastic restoring force of the elastic member 700, soft-closing may also be performed thereon due to the buffer force of the damper 600.

That is, in the present invention, by using the elastic restoring force of the elastic member 700 and the buffer force of the damper 600, the self-closing and the soft-closing can be performed on the moving rail 200.

Referring to FIGS. 1 to 6, the slider 400 is coupled to the body 300 and provided to be selectively movable in the longitudinal direction of the body 300 when the moving rail 200 slidably moves. More specifically, in a state in which the moving rail 200 is completely withdrawn from the fixed rail 100, a state in which the slider 400 is stopped with respect to the body 300 is maintained. When the moving rail 200 is withdrawn while performing the insertion action or in an inserted state, the slider 400 slidably moves along the body 300. Meanwhile, since the transfer pin 500, which will be described below, is in a state of being coupled to the slider 400, the transfer pin 500 also moves in conjunction with the slider 400 when the slider 400 moves.

The elastic member 700 is provided to be disposed between and connected to the body 300 and the slider 400 and elastically compressed or expanded when the moving rail 200 moves. Specifically, when the slider 400 and the transfer pin 500 move rearward due to the insertion action of the moving rail 200, a length of the elastic member 700 gradually decreases due to the restoring force. Conversely, when the slider 400 and the transfer pin 500 move forward due to a withdrawal action of the moving rail 200, the elastic member 700 gradually expands. While the moving rail 200 is withdrawn, the lower protrusion 540 of the transfer pin 500 moves along the first guide passage 311 and enters the second guide passage 312. In this case, the upper protrusion 530 also eccentrically and laterally moves to the first eccentric moving groove 212 from inside the second eccentric moving groove 213 of the transfer pin fixing part 210. Due to the movement of the upper protrusion 530, the moving rail 200 may be separable from the slider 400 and be completely withdrawn forward.

Referring to FIGS. 1 to 6, the transfer pin 500 is rotatably coupled to the slider 400 and provided to move along the guide passage with the slider 400 when the moving rail 200 slidably moves.

More specifically, the transfer pin 500 includes a pin body 510, a rotating shaft part 520 formed on one end portion of the pin body 510 and coupled to the slider 400, the upper protrusion 530 formed on the other end portion of the pin body 510 to protrude from one surface of the pin body 510 and be insertable into a through part 410 formed in the slider 400, and the lower protrusion 540 formed on the other end portion of the pin body 510 to protrude from the other surface the pin body 510 to correspond to the upper protrusion 530 and be movable along the guide passage when the slider 400 moves. That is, the transfer pin 500 is coupled to the slider 400 to be rotatable about the rotating shaft part 520.

The upper protrusion 530 is provided to be insertable into the through part 410 formed in the slider 400. In this case, the through part 410 is formed to extend in a direction intersecting a direction in which the slider 400 moves with respect to the body 300, and the upper protrusion 530 is movable in a longitudinal direction of the through part 410 having a long hole shape.

More specifically, when the moving rail 200 performs the insertion action, the upper protrusion 530 enters the first eccentric moving groove 212 of the transfer pin fixing part 210, which will be described below, and while the moving rail 200 performs the insertion action, the upper protrusion 530 moves into and enters the second eccentric moving groove 213. In this case, the lower protrusion 540 is positioned inside the second guide passage 312, and as described above, moves into the first guide passage 311 according to the movement of the upper protrusion 530. Accordingly, the transfer pin fixing part 210, the transfer pin 500, and the slider 400 fixedly provided on the moving rail 200 are integrally movable (in an insertion direction of the moving rail 200).

The lower protrusion 540 is provided under the pin body 510 to correspond to the upper protrusion 530, and as described above, the arrangement position of the lower protrusion 540 is changed to the first guide passage 311 from a position on the inner fixed surface S of the second guide passage 312 in conjunction with movement of the upper protrusion 530 due to coupling with the transfer pin fixing part 210.

Meanwhile, referring to FIG. 6, an angle θ1 formed by the inner fixed surface S of the second guide passage 312 to which the lower protrusion 540 is fixed and a line L connecting the lower protrusion 540 and the rotating shaft part 520 may be in the range of 70° to 120°. That is, in a state in which the lower protrusion 540 is fixed to the inner fixed surface S of the second guide passage 312, an angle formed by the fixed surface S and the line L connecting the lower protrusion 540 and the rotating shaft part 520 is 70°. In a state in which the lower protrusion 540 is moved to the first guide passage 311, an angle formed by the fixed surface S and the line L connecting the lower protrusion 540 and the rotating shaft part 520 is 120°.

In a case in which the angle θ1 formed by the fixed surface S and the line L connecting the lower protrusion 540 and the rotating shaft part 520 is in the range and the slide device 1000 is operated, restrainability with respect to the transfer pin 500 may be improved, and a loosening phenomenon of the transfer pin 500 due to vibration and the like may be prevented so that the operating performance of the slide device 1000 may be improved. In a case in which the angle θ1 formed by the fixed surface S and the line L connecting the lower protrusion 540 and the rotating shaft part 520 is out of the range, although the operating performance of the transfer pin 500 may be improved, since the slide device 1000 is vulnerable to a loosening phenomenon due to vibration and the like, the overall operating performance of the slide device 1000 may be degraded.

In addition, in a state in which the lower protrusion 540 is positioned on the second guide passage 312, an angle θ2 at which the transfer pin 500 is rotatable about the rotating shaft part 520 may be in the range of 10° to 45°.

When the angle θ2 at which the transfer pin 500 is rotatable about the rotating shaft part 520 is less than 10°, restrainability of the second guide passage 312 with respect to the transfer pin 500 may be degraded, and the slide device 1000 may be vulnerable to a loosening phenomenon and the like due to vibration and the like, and when the angle θ2 at which the transfer pin 500 is rotatable about the rotating shaft part 520 is greater than 45°, since smooth position movement of the transfer pin according to the insertion action of the moving rail is not possible, the operating performance of the slide device 1000 may be degraded.

Meanwhile, referring to FIGS. 7 to 9, the transfer pin fixing part 210 configured to come into contact with the slider 400 and the transfer pin 500 when the moving rail 200 slidably moves is provided on an end portion of one side of the moving rail 200.

The transfer pin fixing part 210 includes the eccentric moving groove 211 configured to accommodate the upper protrusion 530 of the transfer pin 500 so as to slidably move the upper protrusion 530 of the transfer pin 500 to be in a state of being eccentrically moved in a predetermined radius while the transfer pin 500 is slidably moved by the slider 400.

The eccentric moving groove 211 includes the first eccentric moving groove 212, which is provided to extend in a longitudinal direction of the transfer pin fixing part 210 to accommodate the upper protrusion 530 of the transfer pin 500 when the moving rail 200 moves, and the second eccentric moving groove 213 provided to be bent from an end portion of the first eccentric moving groove 212.

A bending direction of the second guide passage 312 with respect to the first guide passage 311 and a bending direction of the second eccentric moving groove 213 with respect to the first eccentric moving groove 212 are opposite. In an initial state in which the moving rail 200 moves to be inserted, the upper protrusion 530 enters the first eccentric moving groove 212, and the lower protrusion 540 is in a state of being positioned in the second guide passage 312. Then, when the moving rail 200 moves further in the direction in which the moving rail 200 is inserted, the upper protrusion 530 eccentrically moves into the second eccentric moving groove 213, and the lower protrusion 540 is in a state of being positioned in the first guide passage 311.

Referring to FIGS. 3 and 4, the damper 600 includes the housing 610 insertion-coupled to the damper accommodation part 320 of the body 300 and the rod 620 which is provided to be movable from the housing 610 in the longitudinal direction and whose one end portion is fixed to the slider 400.

Specifically, a first coupling part 621 and a second coupling part 622 respectively and fixedly insertion-coupled to a first insertion part 420 and a second insertion part 430 of the slider 400, which will be described below, are provided on one end portion of the rod 620, and a neck part 623 concavely recessed to relatively decrease a cross sectional area thereof is provided between the first coupling part 621 and the second coupling part 622. In this case, the first coupling part 621 may have a rectangular hexahedron or cylindrical shape formed on the end portion of the rod 620, the second coupling part 622 may have a cylindrical shape around the rod 620, and a cross sectional area of the rod is less than a cross sectional area of the second coupling head.

The first insertion part 420 formed to be insertion-coupled to the first coupling part 621 and the neck part 623 of the end portion of the rod 620 and the second insertion part 430 formed to be coupled to the second coupling part 622 are provided at one side of the slider 400.

Specifically, the first insertion part 420 may be formed in a shape corresponding to the first coupling part 621 and the neck part 623 of the end portion of the rod 620, and include a neck part insertion groove 421 through which the neck part 623 passes. In this case, the first insertion part 420 may be substantially formed in a "C" shape when viewed from the front. Accordingly, in a state in which the end portion of the rod 620 of the damper 600 is insertion-coupled to the slider 400, the first coupling part 621 and the neck part 623 are in a state of being inserted into the first insertion part 420 of the slider 400. In this case, the rod 620 of the damper 600 is hooked on the neck part insertion groove 421 having a relatively small width so that the rod 620 is coupled to the neck part insertion groove 421. That is, due to coupling of the first coupling part 621 and the first insertion part 420, the end portion of the rod 620 is firmly fixed in the longitudinal direction.

In addition, the second insertion part 430 may be provided to be spaced apart from the first insertion part 420 and formed in a shape corresponding to the second coupling part 622. In this case, the second insertion part 430 may be substantially formed in a "U" shape when viewed from the side. That is, an inner surface 431 of the second insertion part 430 is formed in a shape corresponding to an outer surface of the second coupling part 622 and may be formed in a curved surface.

In addition, an insertion groove may be formed between column parts 432 of both sides of the second insertion part 430 so that the second coupling part 622 may be inserted into the second insertion part 430. In this case, a minimum distance D1 between the column parts 432 of the both sides may be less than a diameter D2 of the second coupling part 622.

In addition, inclined portions 433 which come into contact with the second coupling part 622 to guide the second coupling part 622 to enter the second insertion part 430 when the second coupling part 622 is coupled to the second insertion part 430 may be formed on upper ends of the column parts 432. Since the distance between the inclined portions 433 decreases in a direction toward lower portions of the column parts 432 from upper portions thereof, the second insertion part 430 can be guided to more easily enter the second insertion part 430.

Accordingly, when the second coupling part 622 is coupled inside the second insertion part 430, a hooking sensation is generated, and in this case, the second coupling part 622 is seated in and coupled to the second insertion part 430 while the column parts 432 of both sides of the second insertion part 430 are being widened. After the second coupling part 622 is coupled inside the second insertion part 430, the column parts 432 of both sides are restored to original positions and more firmly fix the second coupling part 622. That is, due to the coupling of the second coupling part 622 and the second insertion part 430, the end portion of the rod 620 is more firmly fixed in a width direction.

In the present invention, since the end portion of the rod 620 of the damper 600 is formed to be directly connected to the slider 400, a structure of the transfer pin 500 may be simplified, and since a structure is provided in which the transfer pin 500 is rotatable with respect to the slider 400 while the moving rail 200 is moving back and forth, a coupling structure between peripheral components and the transfer pin 500 is further simplified so that the durability of the transfer pin 500 may be improved in addition to easy coupling and separation. In addition, in the present invention, for example, when compared to a case in which the end portion of the rod 620 of the damper 600 is directly coupled to the transfer pin 500, since the slide device 1000 does not have a structure in which an impact due to an action of the damper 600 is directly transferred to the transfer pin 500, the slide device 1000 has much higher durability.

For example, in a case in which the end portion of the rod 620 of the damper 600 is connected to the transfer pin 500, a coupling structure to be coupled to the end portion of the rod 620 of the damper 600 and a coupling structure to be coupled to the slider 400 should be provided on the transfer pin 500. Accordingly, a disadvantage is generated in that a structure of the transfer pin 500, whose size is relatively small, becomes complex, and since both of the end portion of the rod 620 of the damper 600 and the slider 400 are coupled to the transfer pin 500, a disadvantage is also generated in that the durability of the transfer pin 500 is degraded when the transfer pin 500 moves back and forth for a long time. In addition, since details are required for a process of manufacturing the transfer pin 500 having the relatively small size, there is a difficulty in the manufacturing.

Figure 10:
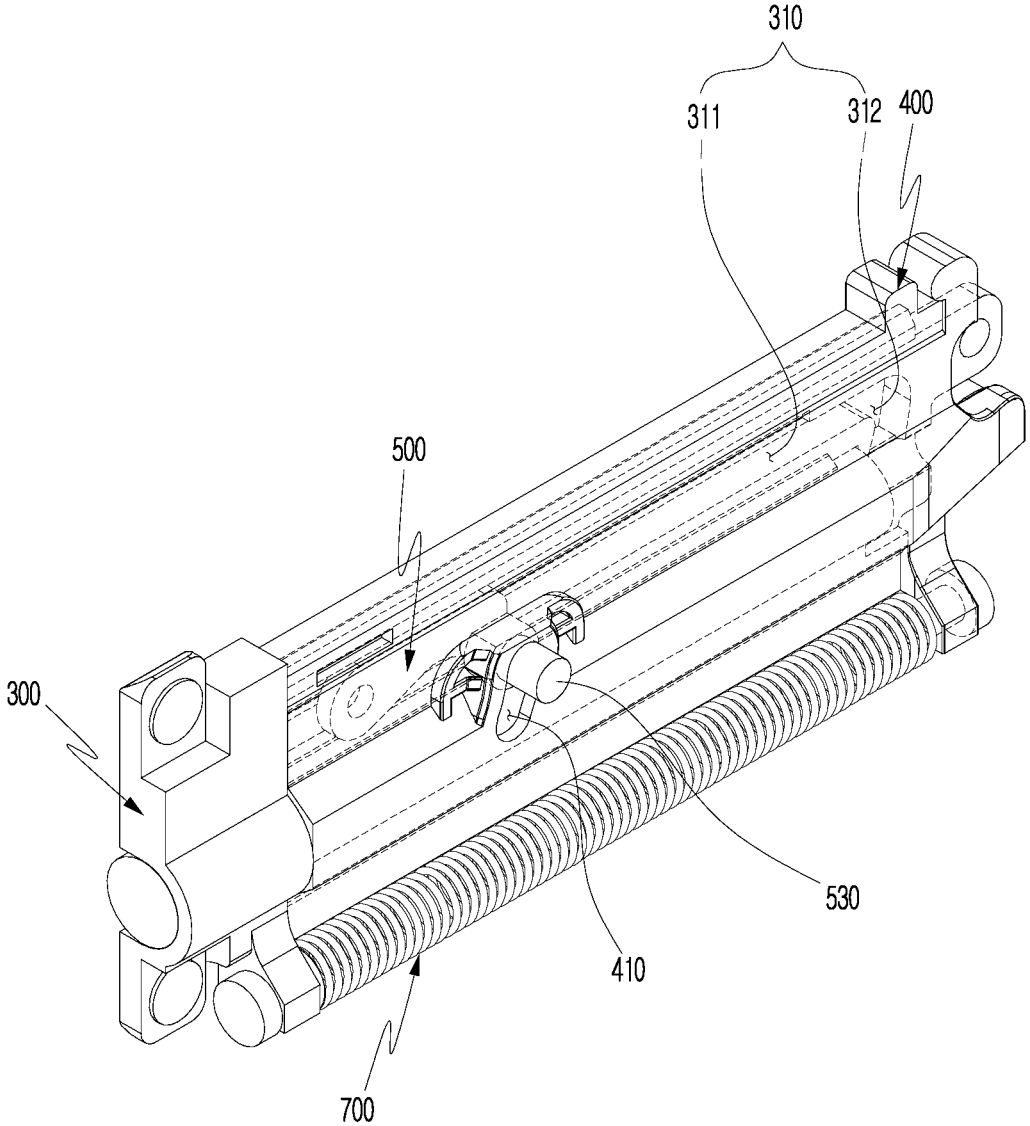
FIG. 10 is a perspective view illustrating a slide device according to another embodiment of the present invention.
Figure 11:
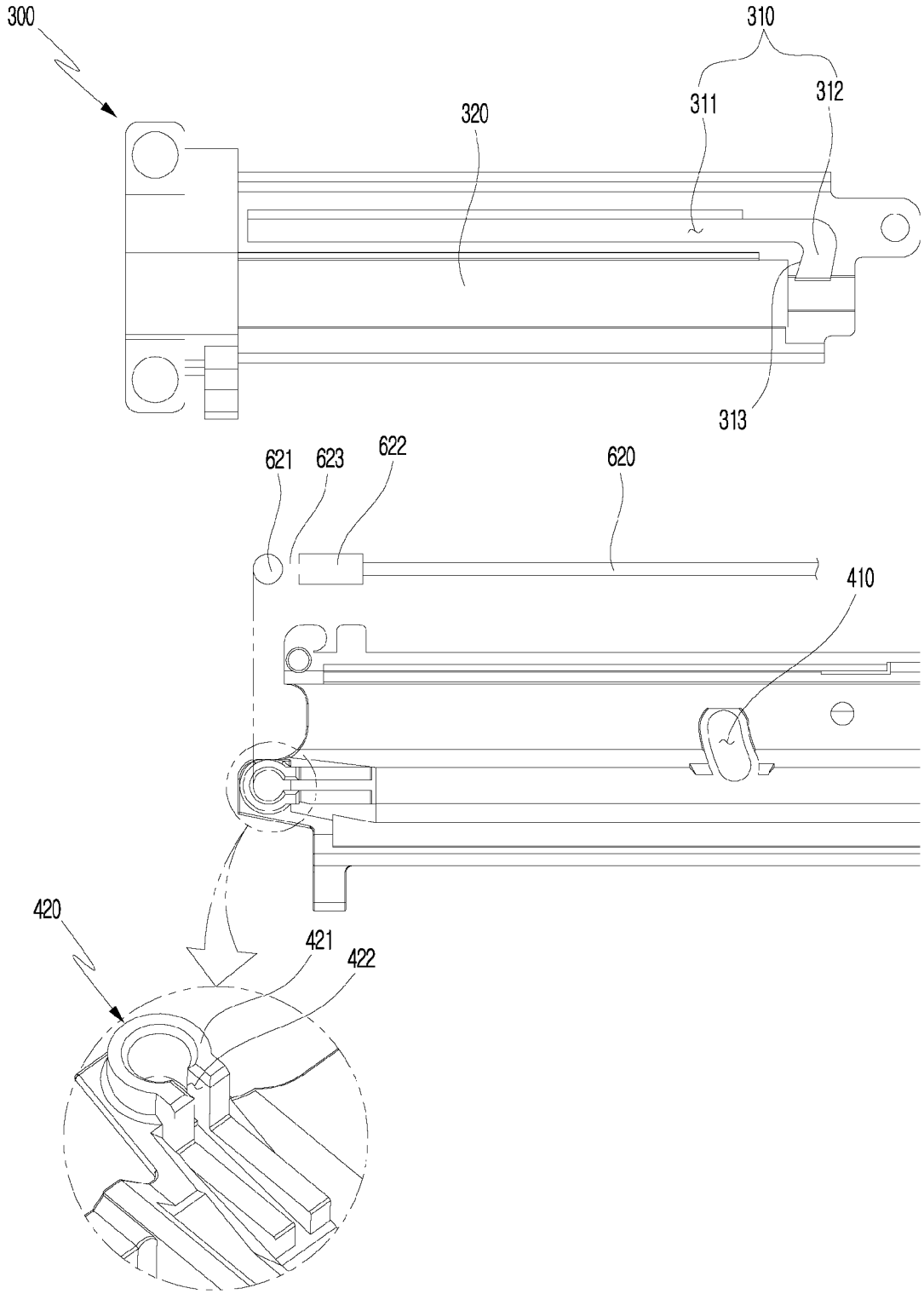
FIG. 11 shows a front view of a body, a rear view of a slider, and an enlarged view illustrating some parts of the slider according to another embodiment of the present invention.

FIG. 10 is a perspective view illustrating a slide device according to another embodiment of the present invention, and FIG. 11 shows a front view of a body, a rear view of a slider, and an enlarged view illustrating some parts of the slider according to another embodiment of the present invention.

Referring to FIG. 10, an elastic member 700 of a slide device 1000 is provided between and connected to a body 300 and a slider 400, and elastically compressed or expanded when a moving rail 200 moves. In this case, the elastic member 700 may be provided to be installed at any one of upper and lower sides of the body 300.

In addition, referring to FIG. 11, a damper 600 includes a housing 610, which is insertion-coupled to a damper accommodation part 320 of the body 300, and a rod 620 which is provided to be movable from the housing 610 in a longitudinal direction and whose one end portion is fixed to the slider 400.

Specifically, a first coupling part 621 and a second coupling part 622 respectively and fixedly coupled to a first insertion part 420 and a second insertion part 430 of the slider 400, which will be described below, are provided on one end portion of the rod 620, and a neck part 623 concavely recessed to relatively decrease a cross sectional area thereof is provided between the first coupling part 621 and the second coupling part 622. In this case, the first coupling part 621 may have a rectangular hexahedron or cylindrical shape formed on an end portion of the rod 620, the second coupling part 622 may have a cylindrical shape around the rod 620, and a cross sectional area of the rod is less than a cross sectional area of the second coupling head.

A first insertion part 420 formed to be insertion-coupled to the first coupling part 621 and the neck part 623 of the end portion of the rod 620 and a seating part on which the second coupling part 622 is seated may be provided at one side of the slider 400. Accordingly, due to the coupling of the first coupling part 621 and the first insertion part 420, the end portion of the rod 620 can be firmly fixed in the longitudinal direction.

The above description is only exemplary, and it will be understood by those skilled in the art that the invention may be performed in other concrete forms without changing the technological scope and essential features. Therefore, the above-described embodiments should be considered as only examples in all aspects and not for purposes of limitation. For example, each component described as a single type may be realized in a distributed manner, and similarly, components that are described as being distributed may be realized in a coupled manner.

The scope of the present invention is defined by the appended claims and encompasses all modifications or alterations derived from meanings, the scope, and equivalents of the appended claims.

REFERENCE NUMERALS

| | |
|---|---|
| 1000: SLIDE DEVICE | 100: FIXED RAIL |
| 200: MOVING RAIL | |
| 210: TRANSFER PIN FIXING PART | 300: BODY |
| 310: GUIDE PASSAGE | |
| 320: DAMPER ACCOMMODATION PART | |
| 400: SLIDER | 410: THROUGH PART |
| 420: FIRST INSERTION PART | 430: SECOND INSERTION PART |
| 500: TRANSFER PIN | 510: PIN BODY |
| 520: ROTATING SHAFT PART | 530: UPPER PROTRUSION |

-continued

| | |
|---|---|
| 540: LOWER PROTRUSION | 600: DAMPER |
| 610: HOUSING | 620: ROD |
| 700: ELASTIC MEMBER | |

The invention claimed is:

1. A slide device comprising:

a fixed rail configured to be fixed to a main body;

a moving rail configured to be movable with respect to the fixed rail;

a guide body disposed in an end region of one side of the fixed rail and including a guide passage;

a slider coupled to the guide body and configured to be slidably movable in a longitudinal direction of the guide body when the moving rail slidably moves;

a transfer pin rotatably coupled to the slider and configured to be movable along the guide passage;

an elastic member disposed between and connected to the guide body and the slider and configured to be elastically compressed or expanded when the slider moves; and a damper disposed on the guide body and including a rod, an end portion of the rod being coupled to the slider, wherein the guide passage includes:

a first guide passage extending in the longitudinal direction of the guide body; and a second guide passage connected to the first guide passage in an end region of the first guide passage and arranged to form an acute angle with respect to the first guide passage, wherein an outer corner portion where an outer surface of the first guide passage and an outer surface of the second guide passage meet is formed to be closed and to have a rounded surface, wherein the rod of the damper includes:

a first coupling head and a second coupling head configured to be coupled to the slider and disposed in the end portion of the rod of the damper, the first coupling head having a cylindrical shape whose longitudinal direction is perpendicular to a longitudinal direction of the second coupling head having a cylindrical shape, and a cross sectional area of the rod is less than a cross sectional area of the second coupling head; and a neck concavely recessed to decrease a cross sectional area of the rod and disposed between the first coupling head and the second coupling head, and wherein the slider includes:

a first insertion protrusion directly protruding from a body of the slider to be formed in a shape corresponding to the first coupling head and configured to be insertion-coupled to the first coupling head; and a second insertion protrusion directly protruding from the body of the slider to be formed in a shape corresponding to the second coupling head and configured to be coupled to the second coupling head.

2. The slide device of claim 1, wherein the transfer pin includes:

a pin body;

a rotating shaft hole formed on a first end portion of the pin body and coupled to the slider;

an upper protrusion disposed on a second end portion of the pin body, protruding from one side surface of the pin body, and insertable into a through hole formed in the slider; and a lower protrusion disposed on the second end portion of the pin body, protruding from another side surface of the pin body to be opposite to the upper protrusion, and movable along the guide passage when the slider moves, wherein the transfer pin is rotatable about a rotating shaft disposed in the rotating shaft hole, with respect to the slider.

3. The slide device of claim 2, wherein, in a state in which the lower protrusion is positioned in the second guide passage, an angle (θ1) formed by an inner fixed surface (S) of the second guide passage which the lower protrusion is in contact with and a line (L) connecting the lower protrusion and the rotating shaft is in a range of 70° to 120°.

4. The slide device of claim 3, wherein, in the state in which the lower protrusion is positioned in the second guide passage, an angle (θ2) by which the transfer pin is rotatable about the rotating shaft is in a range of 10° to 45°.

5. The slide device of claim 1, wherein the first insertion protrusion includes a neck insertion groove into which the neck is to be inserted.

6. The slide device of claim 1, wherein the second insertion protrusion includes:

at least two columns spaced apart from each other; and an insertion groove formed between the at least two columns so that the second coupling head is coupled thereto.

7. The slide device of claim 1, wherein the elastic member is disposed at an upper side or a lower side of the guide body.

* * * * *